US012318651B2

(12) United States Patent
Burkhardt

(10) Patent No.: US 12,318,651 B2
(45) Date of Patent: Jun. 3, 2025

(54) RESISTANCE EXERCISE DEVICE

(71) Applicant: Matthew Burkhardt, East Norwich, NY (US)

(72) Inventor: Matthew Burkhardt, East Norwich, NY (US)

( * ) Notice: Subject to any disclaimer, the term of this patent is extended or adjusted under 35 U.S.C. 154(b) by 237 days.

(21) Appl. No.: 18/147,374

(22) Filed: Dec. 28, 2022

(65) Prior Publication Data

US 2024/0216746 A1 Jul. 4, 2024

(51) Int. Cl.
*A63B 21/00* (2006.01)

(52) U.S. Cl.
CPC ..... *A63B 21/154* (2013.01); *A63B 21/159* (2013.01)

(58) Field of Classification Search
CPC ..... A63B 21/00072; A63B 21/00192; A63B 21/005; A63B 21/0055; A63B 21/008; A63B 21/023; A63B 21/0428; A63B 21/0618; A63B 21/15; A63B 21/153; A63B 21/154; A63B 21/155; A63B 21/157; A63B 21/159; A63B 21/22; A63B 21/225; A63B 21/227; A63B 21/4023; A63B 21/4043; A63B 22/0056; A63B 22/0076; A63B 22/02; A63B 22/0605; A63B 22/0664; A63B 22/205; A63B 23/0405; A63B 2022/0079; A63B 2023/0411; A63B 2071/009; A63B 21/0051; A63B 21/0085; A63B 21/0628; A63B 22/00; A63B 2207/02; A63B 2225/74; A63B 2230/06; A63B 2230/75; A63B 23/0494; A63B 23/085; A63B 24/0062; A63B 24/0087
See application file for complete search history.

(56) References Cited

U.S. PATENT DOCUMENTS

| | | | | |
|---|---|---|---|---|
| 4,463,945 | A | 8/1984 | Spector | |
| 4,765,613 | A | 8/1988 | Voris | |
| 4,811,944 | A * | 3/1989 | Hoff | A63B 23/129 482/905 |
| 4,822,032 | A | 4/1989 | Whitmore et al. | |
| 5,037,090 | A | 8/1991 | Fitzpatrick | |
| 5,885,193 | A * | 3/1999 | Habing | A63B 21/155 482/99 |
| 7,645,216 | B2 * | 1/2010 | Edeker | A63B 21/00 482/92 |
| 8,905,901 | B2 | 12/2014 | Stewart et al. | |
| 9,415,257 | B2 | 8/2016 | Habing | |
| 10,080,919 | B1 * | 9/2018 | Vujicic | A63B 23/0476 |
| 11,628,325 | B2 * | 4/2023 | Pinkart | A63B 23/1209 482/119 |
| 2005/0181915 | A1 | 8/2005 | Hoecht et al. | |
| 2013/0337981 | A1 * | 12/2013 | Habing | A63B 21/0618 482/110 |
| 2021/0213322 | A1 * | 7/2021 | Smith | A63B 21/4049 |

(Continued)

*Primary Examiner* — Megan Anderson
*Assistant Examiner* — Andrew M Kobylarz
(74) *Attorney, Agent, or Firm* — Dunlap Bennett & Ludwig, PLLC

(57) ABSTRACT

A bidirectional rotational resistance assembly is provided. The assembly includes a lever coupled to the one or more discs so that a first torque imparted in a first rotational direction on the lever determines a rate of change of each disc's angular momentum in the first rotational direction in such a way as to oppose a second torque imparted in a second rotational direction on the lever, wherein the first and second rotational directions are opposites.

7 Claims, 8 Drawing Sheets

(56) References Cited

U.S. PATENT DOCUMENTS

| | | | | |
|---|---|---|---|---|
| 2023/0122235 | A1* | 4/2023 | Ashby | A63B 22/0605<br>482/57 |
| 2024/0042260 | A1* | 2/2024 | Dixon | A63B 71/0622 |

* cited by examiner

RESISTANCE EXERCISE DEVICE

BACKGROUND OF THE INVENTION

The present invention relates to exercise devices and, more particularly, to a resistance exercise device.

Presently, there are many resistance exercise devices on the market. Most operate by pulling or pushing of a lever. However, the lever only provides resistance in one direction. When resetting the device, pulling, or pushing the lever back to its original position, no resistance is provided. This results in a less efficient work out.

Some devices can provide resistance in both directions. Though they utilize compression pads, essentially acting as brake pads. This results in wear and tear of moveable pieces which lose resistance over time if not replaced. There also some with no friction but have a period of no-resistance when changing direction.

As can be seen, there is a need for a resistance exercise device that can generate resistance in both directions without replacement parts.

SUMMARY OF THE INVENTION

In one aspect of the present invention, a method of providing bidirectional rotational resistance to a lever through a rotational force reaction of one or more discs includes the following: coupling the one or more discs to the lever so that a first torque imparted in a first rotational direction on the lever determines a rate of change of each disc's angular momentum in the first rotational direction in such a way as to oppose a second torque imparted in a second rotational direction on the lever, wherein the first and second rotational directions are opposites; and further including the following: operatively associating a spindle to the lever by way of a spindle clutch; radially connecting a rod to the spindle for each disc; and rotatably connecting each disc to a respective rod by way of a disc clutch; and operatively associating a fixed gear and a disc gear between the rod and the disc, wherein the fixed gear and the disc gear comprise a planetary gear multiplier system.

In another aspect of the present invention, a bidirectional rotational resistance assembly including the following: a lever coupled to the one or more discs so that a first torque imparted in a first rotational direction on the lever determines a rate of change of each disc's angular momentum in the first rotational direction in such a way as to oppose a second torque imparted in a second rotational direction on the lever, wherein the first and second rotational directions are opposites.

In yet another aspect of the present invention, the bidirectional rotational resistance assembly further includes a spindle operatively associated with the lever by way of a spindle clutch; a rod radially connected to the spindle for each disc; each disc rotatably connected to a respective rod by way of a disc clutch; and a fixed gear and a disc gear operatively associated between the rod and the disc, wherein the fixed gear and the disc gear comprise a planetary gear multiplier system.

These and other features, aspects and advantages of the present invention will become better understood with reference to the following drawings, description, and claims.

DETAILED DESCRIPTION OF THE INVENTION

Figure 1:
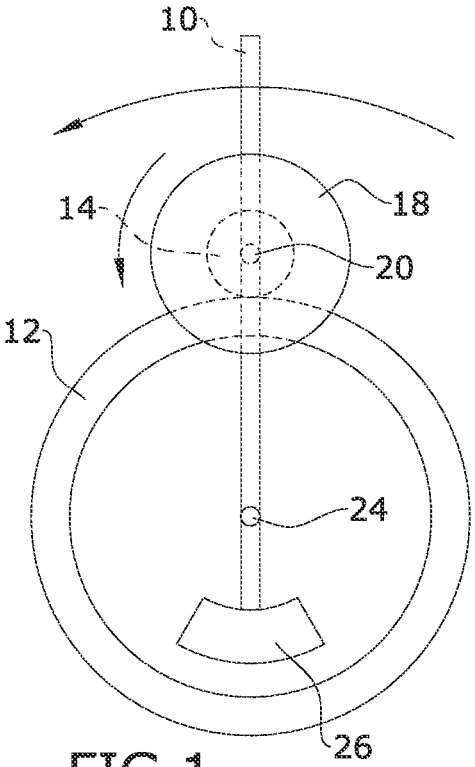
FIG. 1 is a side elevation view of a first embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims with reference to the drawings.

A general overview of the various features of the invention will be provided, with a detailed description following. Broadly, an embodiment of the present invention provides a resistance exercise device. The device may generate resistance in both directions of exercise motions.

The present invention may comprise portions or parts of a resistance-based exercise apparatus wherein an exercise bar may move in two directions and resistance is generated in each direction.

The present invention may utilize a resistance assembly to provide a resistive reaction to moments and forces produced by at least one spinning disc. In some embodiments, reciprocally powered wheels with damper vanes are utilized for resistance.

Resistance may be achieved by moving or compressing a fluid or reversing a weight's movement or reversing a wheel's spin. The present invention may also utilize resistance by counter-moment of spinning discs. Advantageously, discs will not have to reverse direction for resistance to be achieved in an opposite direction.

During the power motion, the resistance assembly resists the user's movement due to the disc rotation. The reactions can be seen in the demonstration of a person in swivel chair holding out a spinning, horizontal wheel. The spinning forces, or angular momentum of the wheel, urges the chair to rotate in a direction that generates its own angular momentum to conserve momentum. An external force stopping the chair would not stop wheel spin, and the wheel spin would not cause the chair to resist the external force. If the wheel accelerates, the chair would resist, similar to a motorcycle resisting gravity in a sudden-start wheelie. In the application, the user likewise accelerates the disc in the power phase.

In all embodiments, the user will move their limbs along a first plane, such as the vertical plane, though it is understood that in some embodiments the user could have its resistance mechanism laid horizontally—i.e., the resistance principle could be used in horizontal and linear user movements. Some orientation may introduce an unwanted rotational force due to a possible gravity effect (uphill rotations adding a local weight-like force while downhill ones subtract). This force may counter resisting force. To rid this extra force, rotating parts downstream of the user lever may be set on a horizontal plane.

A user may operate the present invention by a circular motion. A hip or shoulder may line up with a user lever, though it understood other joints may be engaged with the resistance of the present invention. The user lever may comprise an adjustable sleeve or bracket to accommodate a user's hand or foot (not shown). The device may provide one user lever for each limb of the user. In some embodiments, a single limb will work more than one disc/disc rod. In some drawings the disc rods are not labeled, and the user's exercise bar basically doubles as a disc rod, but it is still one user bar per limb even when there are a few discs.

Figure 2:
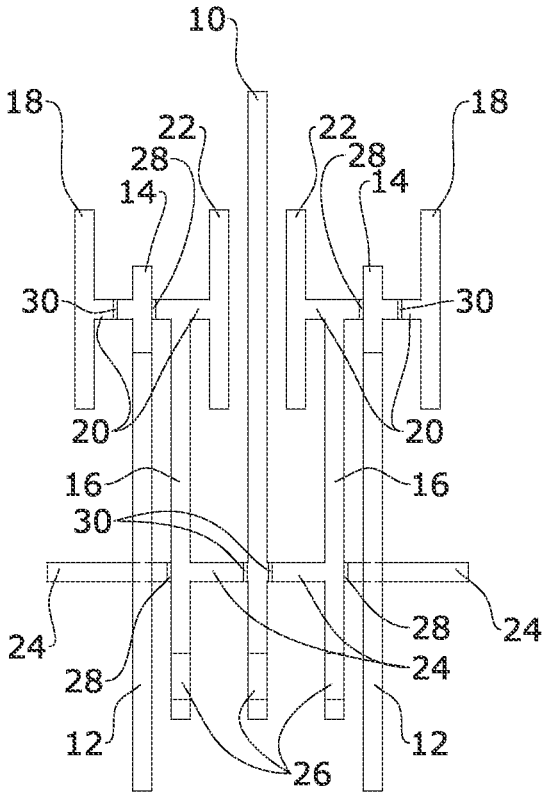
FIG. 2 is a front elevation of the first embodiment of the present invention.

Referring now to the Figures, FIGS. 1 and 2 show two power connections 30, such as a clutch, on a center spindle 24. The user may engage the user lever 10, which engages the power connections 30 on the center spindle 24. The disc rod 16 rotates, along with a section of center spindle 24 between the disc rod 16 and user lever 10. Closer to an end of the center spindle 24 is a free rotation connection 28. The free rotation connection 28 is not a clutch and enables resistance-free rotation in either direction. This keeps the outer section of the center spindle 24 still. In some embodiments of the present invention, the outer section of the center spindle 24 attaches to a frame support of an exercise apparatus.

When moving in the powered direction, i.e., the direction in which the user is presently applying force, the disc rod 16 moves its disc gear 14 along the stationary gear ring 12, forcing the disc gear 14 to rotate. In this rotary direction the power connection 30, located on the disc spindle 20, locks and rotates the disc 18. When the user completes his power motion, the user lever 10 comes to a stop. The power connection 30 on the center spindle 24 disengages, like a bicycle pedal crankshaft when coasting. The disc rod 16 loses its power. Its respective disc gear 14 stops moving along the stationary gear ring 12 and stops rotating. Its respective power connection 30, on the disc spindle 20 disengages, allowing the disc 18 to continue its spin. As a result, during the power motion, the resistance assembly resists the user's movement due to imparting disc 18 rotation.

After power connections 30 disengage, the disc's rotation forces the now unpowered disc rod 16 to reverse direction, or, depending on its deceleration, move slowly in the original direction. The disc rod 16 will not force movement of the user lever 10 because the power connection 30 between them has disengaged.

Rotation of the disc gear 14 during the unpowered phase will counter rotation of the respective disc 18. The unpowered phase may be when the clutch is disengaged and applies to a side of the machine that is not presently in the power phase. In some embodiments, the disc gear 14 may be relatively small to prevent motion nullification in the disc rod 16 and for a low augmentation of rotation in the disc's unpowered phase. The disc gear 14 may be small for good rotation multiplication.

At this point, the user may reverse direction of the user lever 10. This would be a recovery movement in most exercises, but the present invention offers resistance from the disc 18 on the opposite side of the user lever 10 acting in the same manner as the disc that was previously powered. When the user reverses again to repeat the original power motion, both power connections 30 on the side of the user lever 10 in the power motion engage or close the original power motion, repeating the process.

At the end of the user lever 10 and each disc rod 16 is a counterweight 26. Disc counterweights 22 are situated opposite discs, at the other end of disc spindles 20. None of these weights may be essential but they could smooth the operation.

As long as the user applies force to the user lever 10, force will be applied to the disc 18, creating a force-reaction. After the user completes the power stroke, the behavior of the disc rod depends on the amount of disc's rotational deceleration. If deceleration is low enough to be powerless, the rod may reverse direction to conserve the disc's rotational momentum. If deceleration is high enough to null this effect, the rod may continue in its original direction. In the first case, the user's reengagement will face resistance from reversing the rod. In the second case, resistance will come from accelerating the disc. These resistances are in addition to the force reaction created by the user's exertion. When the discs are unpowered, movement of the disc rod in the original direction might assist the user in the power phase of the counterstroke, so a slow deceleration would be preferable.

Put another way, if the user releases the user lever 10, moment reaction of a spinning (but unpowered) disc 18 may keep the clutches engaged. Moving the user lever 10 with force in this new direction (and by connection, the disc rod 16) would disengage the power connectors 30. Even if the power connection remained, the moment reaction would have little influence; the force reaction of the disc 18 on an opposite side of the spinning disc 18 would overpower any assistance it gives.

The user may accelerate the disc gear 14 to high speed on each stroke to get a strong force reaction. This will be less achievable if disc 18 decelerates when unpowered. In this event, the reverse motions of the disc rods 16 sustain, and resistance will come mainly from sending the disc rods 16 back in the original direction on the next engagement. If high deceleration of disc 18 takes place, an associated disc rod 16 bar will decelerate when unpowered, giving little resistance. However, high deceleration of disc 18 will allow the user to accelerate them on every stroke. The work needed to accelerate the disc 18 and the associated force reaction will provide resistance. If the disc 18 decelerates little, it is important that the power connection 30 between the user lever 10 and the disc rod 16 has a hub that stays disengaged when the disc rod 16 reverses in its unpowered phase. Engagement of the unpowered disc rod 16 would assist the user in moving the opposite disc rod 16 during its power phase. This assistance in the high-deceleration scenario would be minimal due to the slow movement of the unpowered bar and the force reaction of the powered disc 18. Also, if deceleration of the unpowered disc 18 creates a negative force, its disc rod 16 would decelerate in the unpowered phase, further minimizing the assist.

Figure 3:
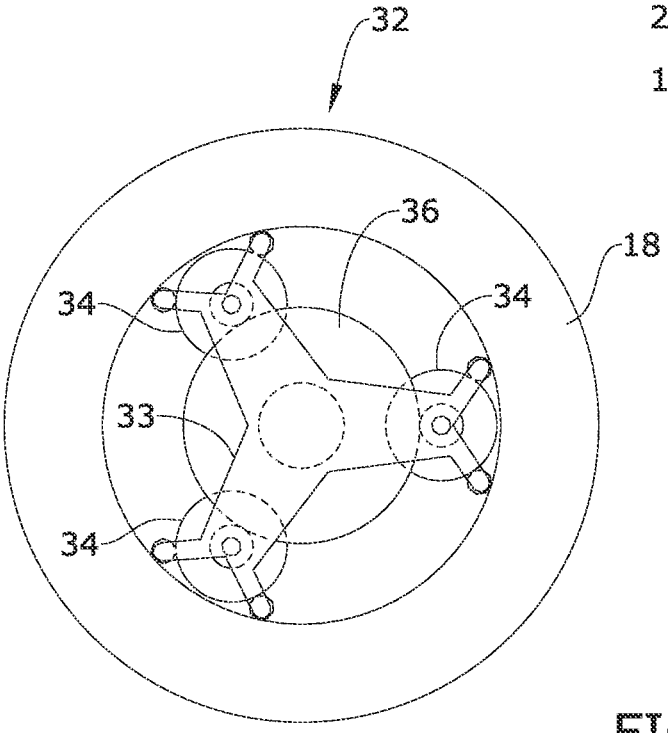
FIG. 3 is a detailed elevation view of a planetary gear system which may be utilized with all embodiments of the present invention.

These and other embodiments of the present invention may use a planetary gear multiplier system 32 seen in FIG. 3. FIG. 3 details planet gears 34 and sun gear 36. The planetary gears make the discs more like rings (herein referred to as "disc"). The planetary gear multiplier system 32 may have mediating gears (between planets and ring)—i.e., additional smaller gears connect the planet gears 34 to an inner flange of the disc 18. The planet gears 34 are also the multipliers. Each planet gear 34 may comprise two concentric gears. The smaller of the two contact the sun gear 36. The larger of the two contact a pair of small gears that contact the inner rim of the disc 18. The multipliers turn the disc 18 at greater angular speed than the disc gear 14. The extra speed is important and useful in limiting the size of the discs 18. The planetary gear multiplier system 32 may have planetary gears with "enmeshed planets" that reversed the ring rotation. Some embodiments of the planetary gear multiplier system 32 may include concentric gears for extra power. The planetary gear multiplier system 32 may be used in any embodiment, even though it is shown in FIGS. 13, 16, 17, 21, and not shown in 1, 7, 8, 10.

Figure 4:
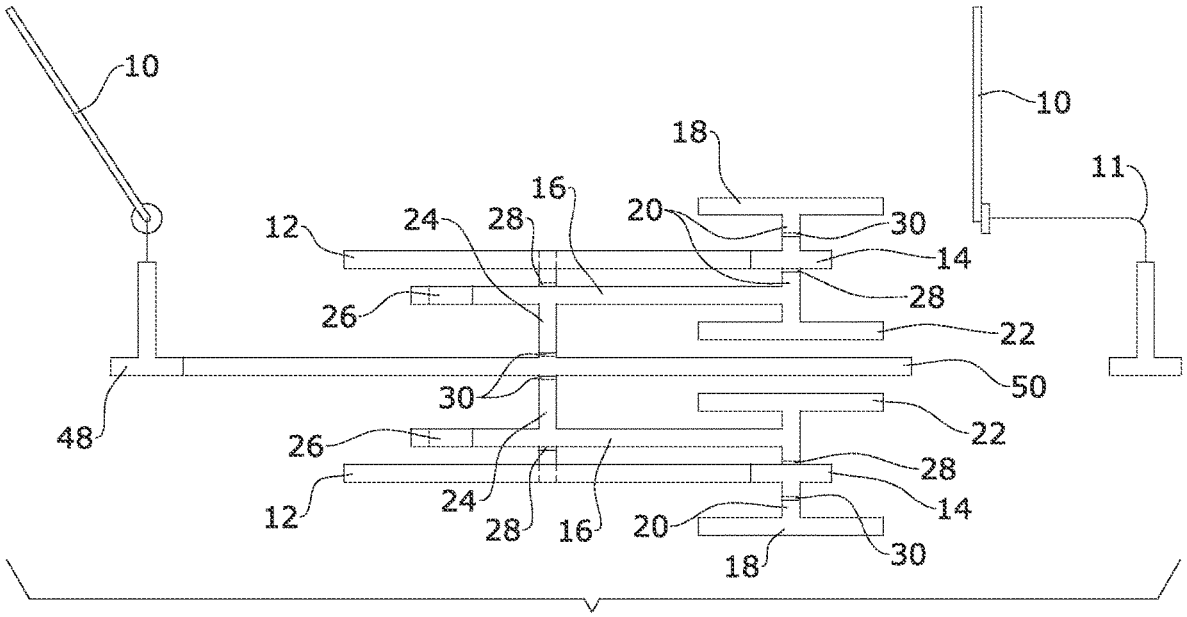
FIG. 4 is a view of an alternate version of the first embodiment, showing the same face of the device as FIG. 2, but with the device rotated 90 degrees on the page, wherein the device is horizontal, but the user lever is vertical. The CV/bevel joint 11 is used to get the rotation through the bend shown in the upper right detail of FIG. 4, illustrating the lever and its connecting parts rotated 90 degrees about a vertical axis, wherein gears 48 and 50 come between the user lever and the spindle 24 along with the CV/bevel joint 11 and the horizontal and vertical shafts (shown as mere lines).
Figure 5:
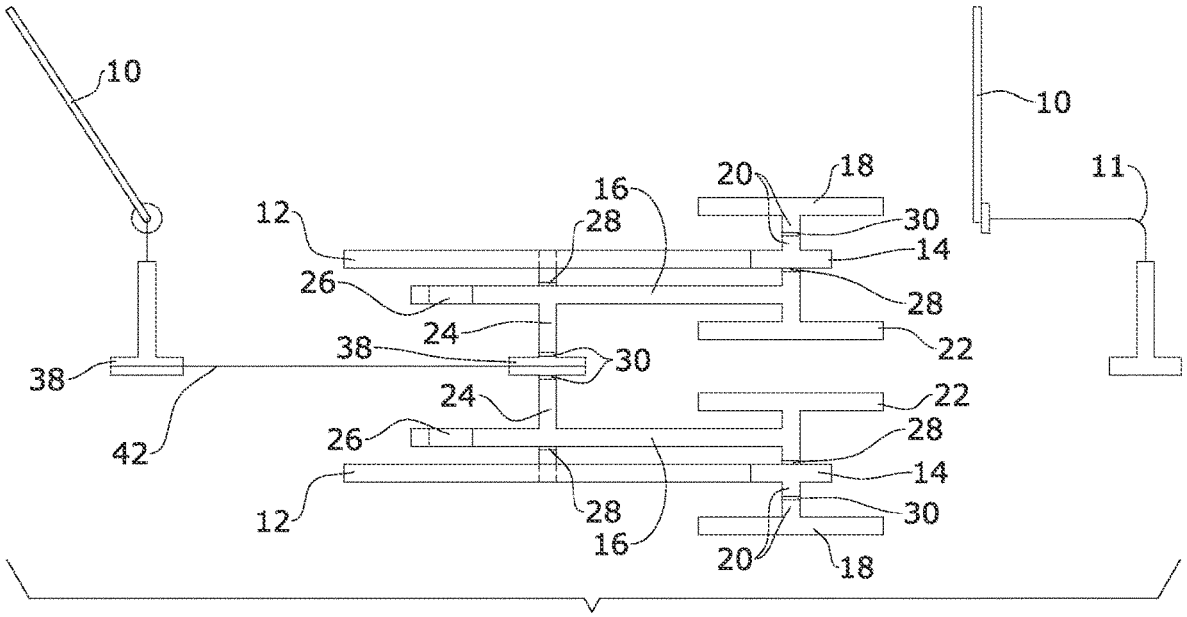
FIG. 5 is a view of an alternate version of the first embodiment of FIG. 4 but utilizing sprockets 38 and a chain 42 instead of gears 48 and 50.

FIGS. 4 and 5 show the resistance mechanism of FIG. 2 flipped horizontally. In both figures, the user lever 10 connects to a shaft, which connects to either a bevel or constant velocity joint (position indicated by 11), and then to another shaft. The bevel/CV joint is configured to transfer the horizontal rotary motion (initiated by the user lever 10) to a vertical rotary motion, reaching the gear 48. In FIG. 4, a stationary gear ring is no longer stationary and becomes a rotational member, a large gear 50. It connects with small gear 48. Alternatively, a sprocket 38 and chain 42 may be used as shown in FIG. 5.

Figure 6:
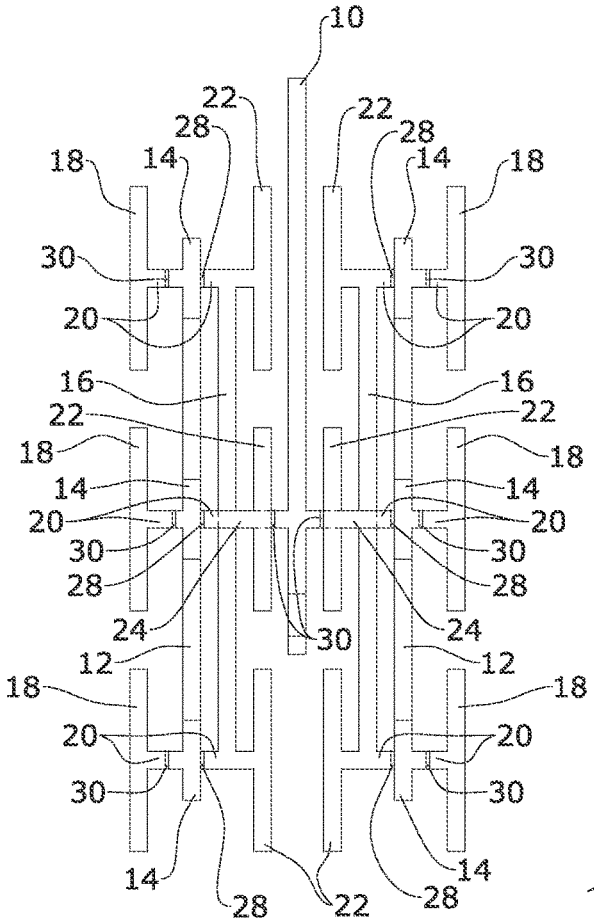
FIG. 6 is a front elevation view of the second embodiment of the present invention.
Figure 7:
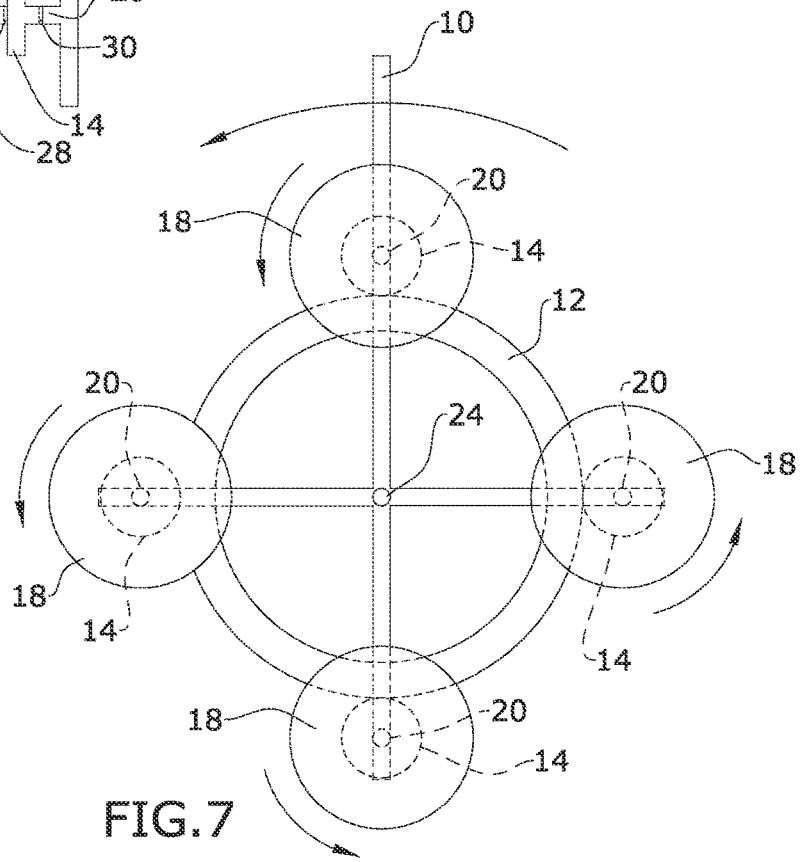
FIG. 7 is the side elevation view of thereof.

FIGS. 6 and 7 represent an alternate embodiment of the present invention with four discs 18 on each side of the user lever 10. The disc rod counter weight 26 is absent from this embodiment as the four discs 18 balance each other.

Figure 8:
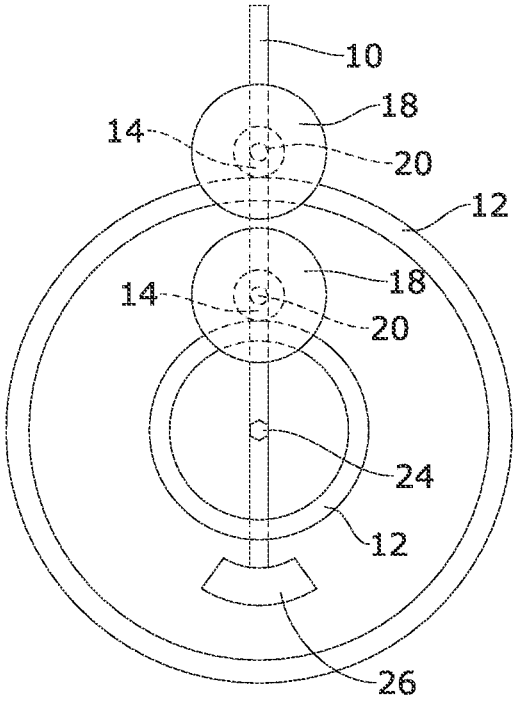
FIG. 8 is a side elevation view of the third embodiment of the present invention.
Figure 9:
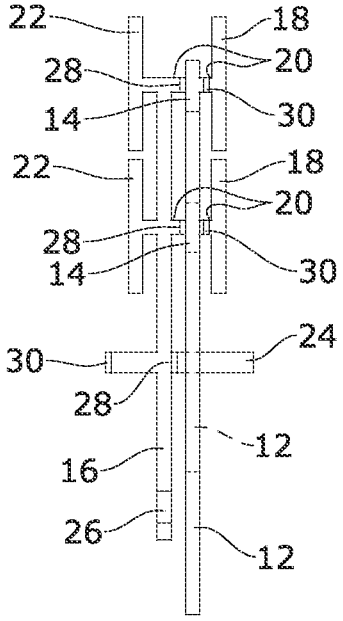
FIG. 9 is a front elevation view thereof.

FIGS. 8 and 9 represent an alternate embodiment of the present invention with two discs on one rod.

Figure 10:
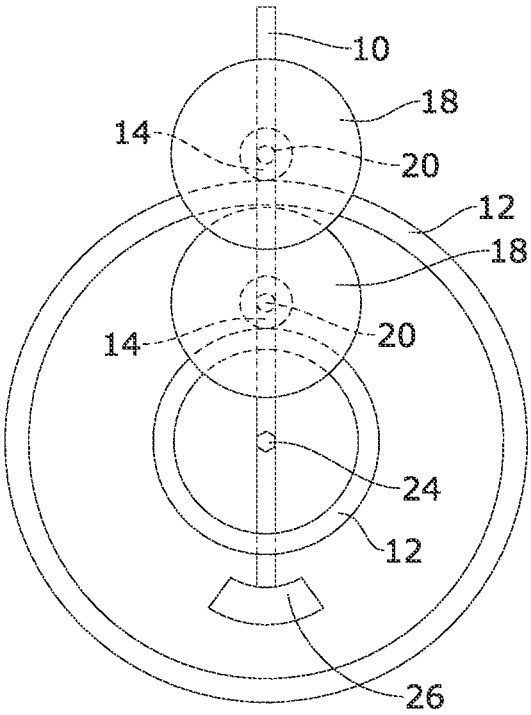
FIG. 10 is a side elevation view of an alternate version of the third embodiment thereof.
Figure 11:
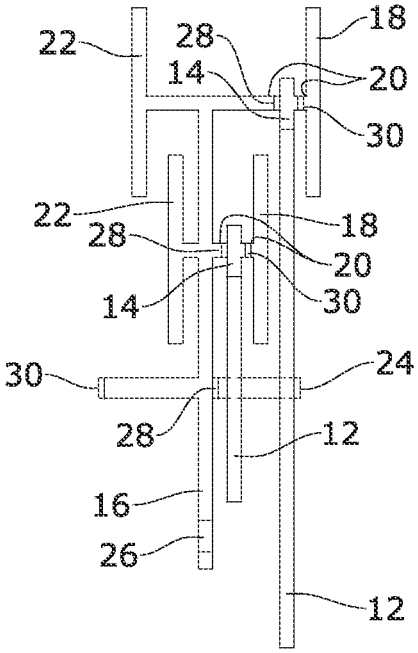
FIG. 11 is a front elevation view thereof.

FIGS. 10-11 represent an alternate embodiment of the present invention with two discs on one rod with discs over lapping and offset.

Figure 12:
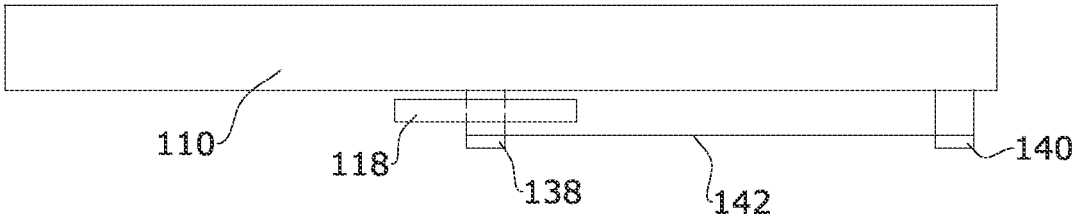
FIG. 12 is top plan view of the fourth embodiment of the present invention.
Figure 13:
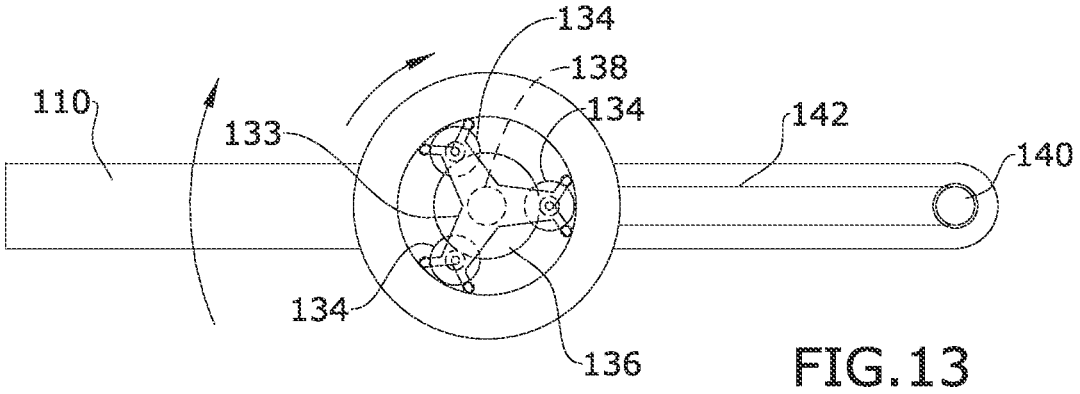
FIG. 13 is a side elevation view thereof.

FIG. 12 and FIG. 13 feature an alternate embodiment that does not use a disc gear 14 or stationary gear ring 12. A fixed sprocket 140 is mounted so that it does not turn. The user rotates an alternate embodiment of the user lever 110 so that it pivots about the fixed sprocket 140. A chain 142 loops around the fixed sprocket 140 and second sprocket 138. The second sprocket 138 rotates as the alternate embodiment of the user lever 110 pivots, turning the alternate embodiment of the disc 118, which generates a resisting reaction. As shown, the alternate embodiment of the disc 118 does not coast or maintain a constant direction of rotation. For this reason, the alternate embodiment of disc 118 and fixed sprocket 140 assembly may be very shear resistant. FIG. 13 is shown with the planetary gear multiplier system 132 replacing disc 118.

Figure 14:
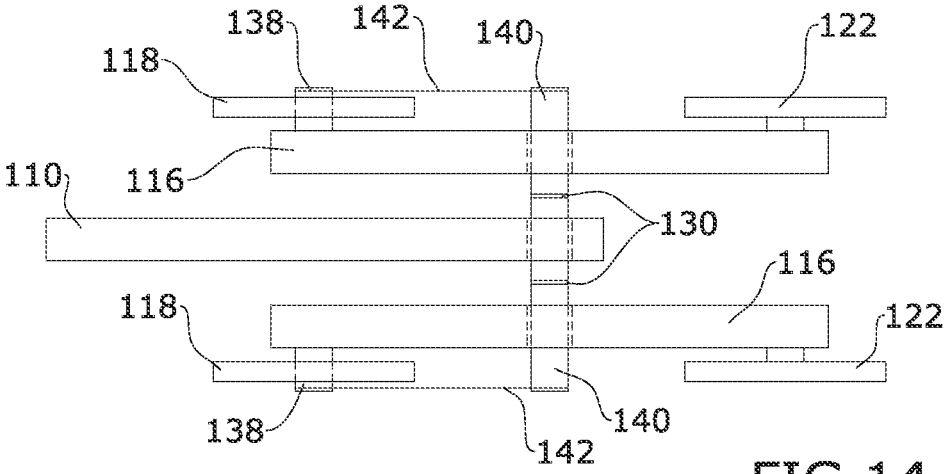
FIG. 14 is a top plan view of the fifth embodiment of the present invention.

In some embodiments, this setup may feature pairs of discs rotating in opposition, each disc rotating in one direction with a clutch to allow coasting as shown in FIG. 14. FIG. 14 is like FIG. 12, but it is an alternate embodiment that includes two power connections 130, an alternate embodiment of disc rods 116, and an additional alternate embodiment of discs 118. The user moves the alternate embodiment of the user lever 110. An alternate embodiment of the power connections 130 will engage, forcing the alternate embodiment of the near-side disc rod 116 to rotate in the same direction of the alternate embodiment of the user lever 110. On the user's countermovement/counterstroke, the alternate embodiment of the power connection 130 disengages. The alternate embodiment of the power connection 130 on the opposite side engages, and the entire assembly on its side is driven for power. The actions of the alternate embodiment of the disc rods 116 and alternate embodiment of the discs 118 are similar to those in the versions of first embodiment covered as shown in FIGS. 1-4, though no power connections 130 at the discs or stationary gear rings 12 are used. The alternate embodiment of the disc rods 116 may optionally feature counterweights 22. Unlike the embodiment of FIG. 12, discs and chains maintain rotational direction.

Figure 15:
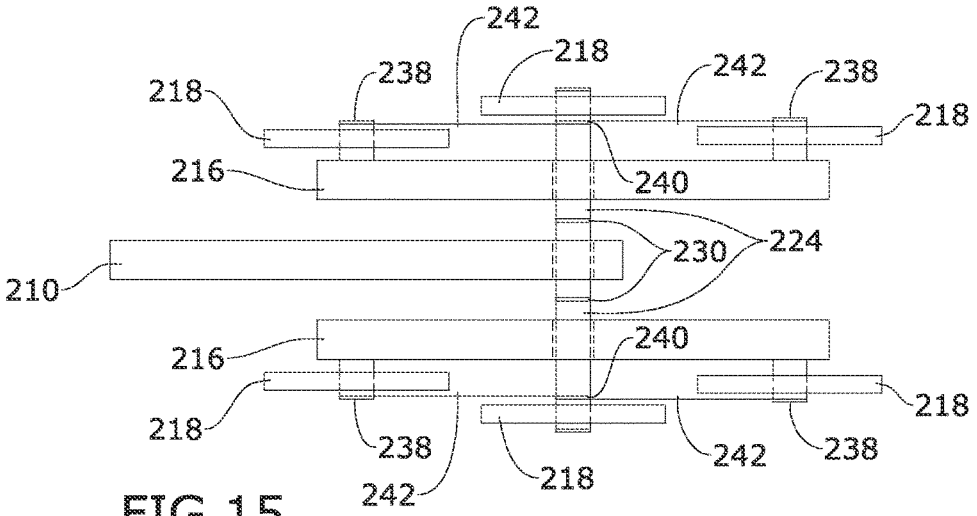
FIG. 15 is a top plan view of an alternate version of the sixth embodiment thereof.
Figure 16:
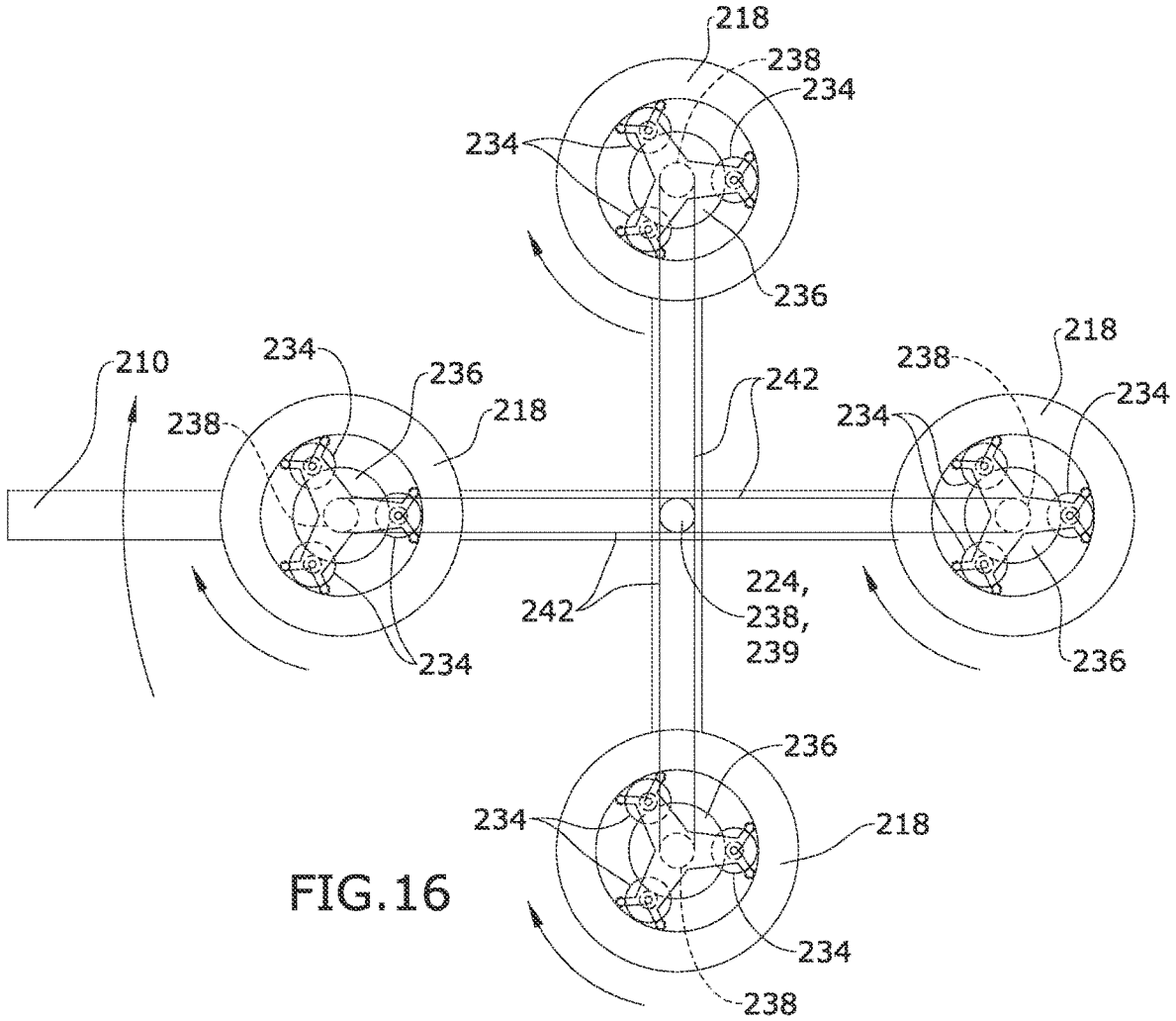
FIG. 16 is a side elevation view thereof.

FIGS. 15 and 16 show an embodiment similar to FIG. 14 but with four discs 118 on each side of the alternate embodiment of the user lever 110, two offset chains 142, and no dead-mass counter weighting. Each side may utilize two offset fixed sprockets 140 and four sprockets. To ensure chain traction, the fixed sprockets 140 may require a greater diameter (like the larger sprocket 339 in FIG. 21). Alternatively, there may be four offset chains per side, requiring stacks of four fixed sprockets 140. No larger diameter would be needed in such an arrangement.

Figure 17:
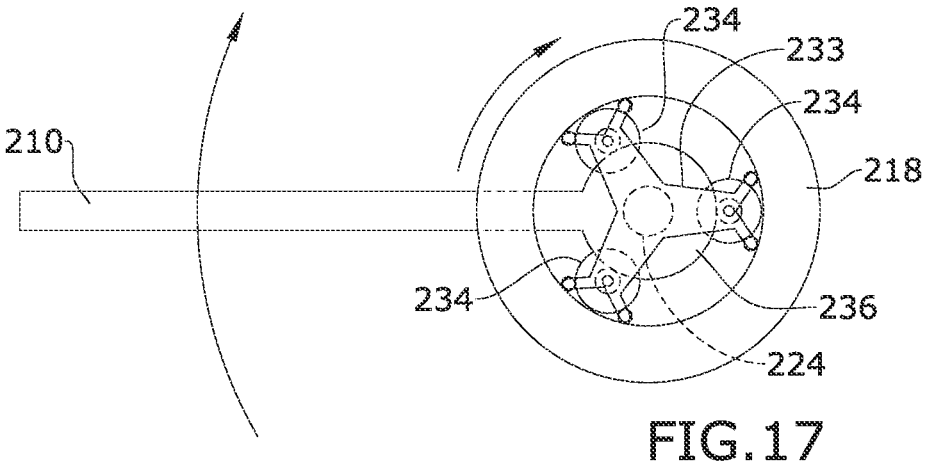
FIG. 17 is a side elevation view of the seventh embodiment of the present invention.
Figure 18:
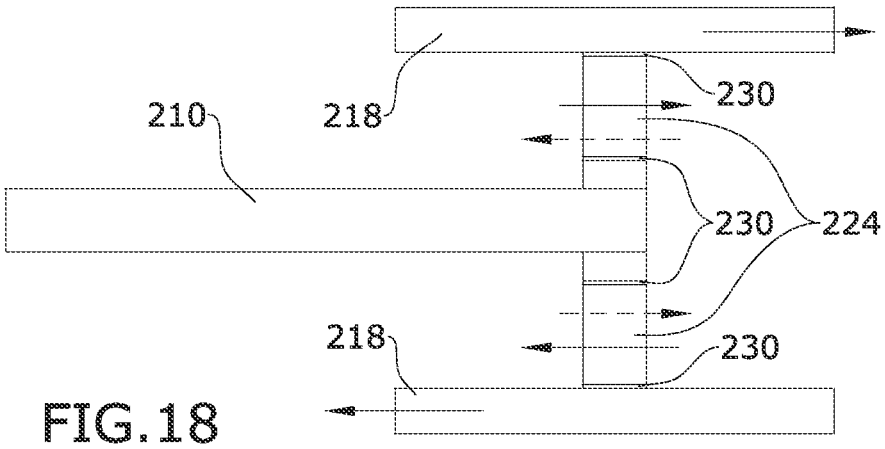
FIG. 18 is a top plan view thereof.

FIGS. 17 and 18 are side and top views respectively of an embodiment that uses no stationary gear ring or chain. The user moves a third embodiment of the user lever 210, engaging power connections 230. This turns a spindle section between and an end power connection 230. This end power connection engages and moves the third embodiment of the disc 218. Inner power connections (near the third embodiment of the user lever 210) may be optional. If so, the entire spindle and powered disc rotate in the same direction. Only the coasting disc would rotate in the opposite direction. With only two power connections 230, there is more mass-motion inequality between each side ensuring symmetry about the pivot and lever do not cancel equal forces. With two sets of power connections 230 (an inner and outer set), the spindle sections may become independent but move in the same direction as the adjacent disc. This may equalize mass-motion.

Alternatively, one set of power connections may be utilized at equal distance from the third embodiment of the user lever 210 not at any distance shown in the drawing. An effective spot may then be determined by trial and error.

In the two pair connection arrangement of FIGS. 17 and 18, there should be some mass-movement inequality and especially a force inequality because the powered disc accelerates (rapidly if a planetary system is in the hub) while the coasting disc slowly decelerates. If deceleration results in a negative force, a resisting-force may occur in the unpowered disc because it rotates in the opposite direction of the powered one, though its force will quickly wipe out if it reacts to the powered disc. Optionally, the present invention may comprise power connections 230 set near the discs, and a single set with no determined distance from the lever.

Figure 19:
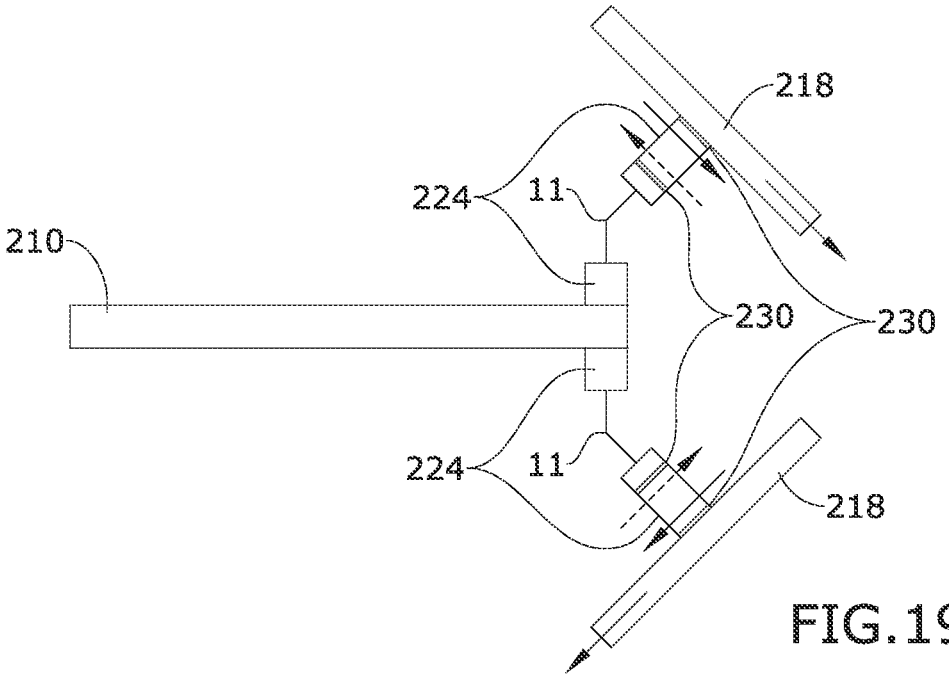
FIG. 19 is a top plan view of an alternate variation of the seventh embodiment thereof.

FIG. 19 applies the principles of the embodiment in FIG. 18, though has an angled spindle (using bevels or constant velocity joints 11) to rid any force or moment interference discs might have with each other.

Figure 20:
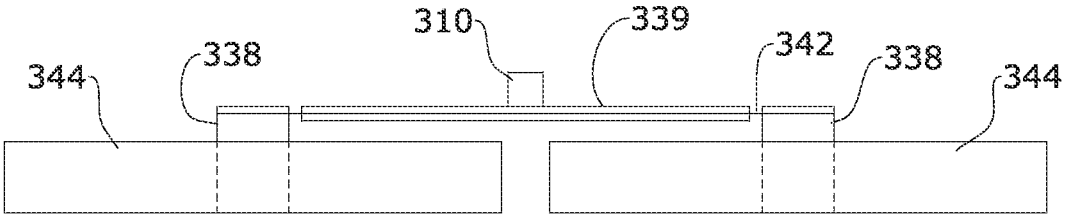
FIG. 20 is a top view of an eighth embodiment of the present invention.
Figure 21:
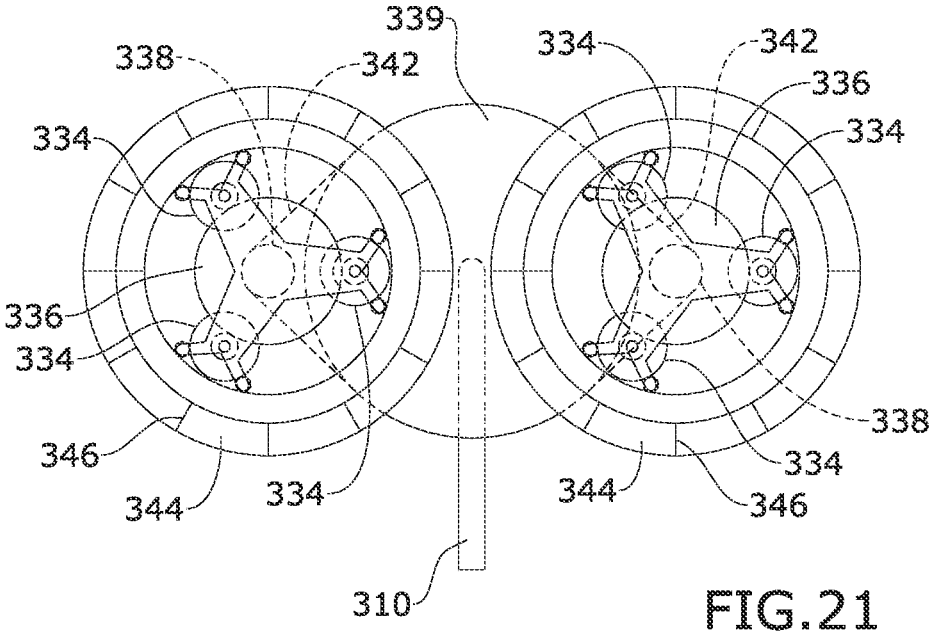
FIG. 21 is a side elevation view thereof.

FIGS. 20 and 21 are top and side views respectively of a fourth embodiment that uses no force reaction. It is much like a bicycle with a sprocket and chain that loop around both front and rear wheel hubs. The user rotates the fourth embodiment of the user lever 310, which turns the fourth embodiment of the sprocket 339 which powers the fourth embodiment of the chain 342 which turns the small sprockets 338. A first sprocket will not power an inertial disc 344 because it is disengaged, while a second sprocket will. During a reverse stroke, the engaged/disengaged disposition switches. Radial damper vanes 346 may be used to add resistance to inertial disc rotation. Like most other embodiments, the user's power disconnects and reconnects from rotation loads. The rotation of each may not be equal on reconnection, but they will match in rotational direction.

It should be understood, of course, that the foregoing relates to exemplary embodiments of the invention and that modifications may be made without departing from the spirit and scope of the invention as set forth in the following claims.

What is claimed is:

1. A method of providing bidirectional rotational resistance to a lever through a rotational force reaction of one or more discs, the method comprising:

coupling the one or more discs to the lever so that a first torque imparted in a first rotational direction on the lever determines a rate of change of an angular momentum of each of the one or more discs in the first rotational direction in such a way as to oppose a second torque imparted in a second rotational direction of the lever; and operatively associating a spindle to the lever through a spindle clutch;

each disc of the one or more discs being connected to a respective rod through a disc clutch, the rods being radially connected to the spindle.

2. The method of claim 1, the method further comprising, for each of the one or more discs, operatively associating a disc gear between the disc and the respective rod.

3. The method of claim 2, wherein the disc gear comprises a planetary gear multiplier system.

4. The method of claim 1, wherein the first rotational direction and the second rotational direction are opposite rotational directions.

5. A bidirectional rotational resistance assembly, comprising:

a lever coupled to one or more discs so that a first torque imparted in a first rotational direction on the lever determines a rate of change of an angular momentum of each of the one or more discs in the first rotational direction in such a way as to oppose a second torque imparted in a second rotational direction of the lever, wherein the first rotational direction and the second rotational direction are opposite rotational directions; and a spindle operatively associated with the lever through a spindle clutch;

each disc of the one or more discs being connected to a respective rod through a disc clutch, the rods being radially connected to the spindle.

6. The assembly of claim 5, further comprising, for each of the one or more discs, a disc gear operatively associated between the rod and the disc and the respective rod.

7. The assembly of claim 6, wherein the disc gear comprises a planetary gear multiplier system.

* * * * *